US009371680B2

(12) United States Patent
Finke

(10) Patent No.: US 9,371,680 B2
(45) Date of Patent: Jun. 21, 2016

(54) SLIDING DOOR SYSTEM COMPRISING A LOCKING UNIT DISPLACEABLY SUPPORTED IN A TRANSOM

(75) Inventor: Andreas Finke, Gevelsberg (DE)

(73) Assignee: DORMA DEUTSCHLAND GMBH (DE)

( * ) Notice: Subject to any disclaimer, the term of this patent is extended or adjusted under 35 U.S.C. 154(b) by 1734 days.

(21) Appl. No.: 11/596,424

(22) PCT Filed: May 10, 2005

(86) PCT No.: PCT/EP2005/005014

§ 371 (c)(1), (2), (4) Date: Nov. 10, 2006

(87) PCT Pub. No.: WO2005/111355

PCT Pub. Date: Nov. 21, 2005

(65) Prior Publication Data

US 2008/0256872 A1 Oct. 23, 2008

(30) Foreign Application Priority Data

May 12, 2004 (DE) ..... 10 2004 023 926

(51) Int. Cl.
*E05F 15/603* (2015.01)
*E05F 15/643* (2015.01)

(52) U.S. Cl.
CPC ..... *E05F 15/603* (2015.01); *E05F 15/643* (2015.01); *E05Y 2201/22* (2013.01); *E05Y 2201/246* (2013.01); *E05Y 2201/434* (2013.01); *E05Y 2900/132* (2013.01)

(58) Field of Classification Search
USPC ..... 49/449, 360, 279, 280, 324, 366, 370, 49/118, 120; 292/137, 251.5, 144
IPC ..... E05F 15/603,15/643; E05Y 2201/22, E05Y 2201/246, 2201/132, 2900/132
See application file for complete search history.

(56) References Cited

U.S. PATENT DOCUMENTS 2,332,028 A * 10/1943 Taylor ..... 49/102
3,285,209 A * 11/1966 Pace ..... 109/8
4,087,939 A * 5/1978 Elguindy et al. ..... 49/118

(Continued)

FOREIGN PATENT DOCUMENTS

| | | |
|---|---|---|
| DE | 28 54 813 | 6/1980 |
| DE | 44 15 708 | 7/1995 |
| JP | 2002-115448 | 4/2002 |

OTHER PUBLICATIONS

Search Report dated Sep. 5, 2005 for the underlying International Application No. PCT/EP2005/005014.

*Primary Examiner* — Gregory Strimbu
(74) *Attorney, Agent, or Firm* — Cantor Colburn LLP

(57) ABSTRACT

A sliding door system including a transom; at least one door leaf movable along the transom; an endless traction mechanism traction-resistantly connected to the at least one door leaf; a drive device for driving the endless traction mechanism, the drive device comprising a driven pulley guiding the endless traction mechanism; a rotational body torsion-resistantly connected to the driven pulley and rotatably supported by the transom, the rotational body comprises a coupling member; a locking bolt displaceably supported by the transom; and an electromechanical actuation device. The electromechanical actuation device is operable to cause the locking bolt to interlock with the coupling member of the rotational body to lock the at least one door leaf relative to the transom.

11 Claims, 5 Drawing Sheets

(56) References Cited

U.S. PATENT DOCUMENTS

| | | | | | |
|---|---|---|---|---|---|
| 4,402,503 | A | * | 9/1983 | Galbierz | 482/5 |
| 4,605,108 | A | * | 8/1986 | Monot | 477/8 |
| 5,004,405 | A | * | 4/1991 | Breslin | 417/131 |
| 5,077,938 | A | * | 1/1992 | Moreuil | 49/362 |
| 5,148,631 | A | * | 9/1992 | Bayard et al. | 49/449 |
| 5,193,307 | A | * | 3/1993 | Chupp | 49/123 |
| 5,341,597 | A | * | 8/1994 | Stoltenberg | 49/199 |
| 5,497,135 | A | * | 3/1996 | Wisskirchen et al. | 335/253 |
| 5,706,552 | A | * | 1/1998 | Hsieh | 16/82 |
| 5,755,060 | A | * | 5/1998 | Zweili | 49/449 |
| 5,823,026 | A | * | 10/1998 | Finke | 70/276 |
| 6,050,116 | A | * | 4/2000 | Cole | 70/256 |
| 6,125,583 | A | * | 10/2000 | Murray et al. | 49/291 |
| 6,265,956 | B1 | * | 7/2001 | Cascolan et al. | 335/234 |
| 6,662,500 | B2 | * | 12/2003 | Inage | 49/116 |
| 7,097,212 | B2 | * | 8/2006 | Willats et al. | 292/1 |
| 2003/0167693 | A1 | * | 9/2003 | Mainini | 49/28 |
| 2004/0049987 | A1 | * | 3/2004 | Hirano | 49/360 |
| 2007/0180772 | A1 | * | 8/2007 | Finke | 49/280 |

* cited by examiner

SLIDING DOOR SYSTEM COMPRISING A LOCKING UNIT DISPLACEABLY SUPPORTED IN A TRANSOM

CROSS-REFERENCE TO RELATED APPLICATIONS

This is a U.S. national stage of International Application No. PCT/EP2005/005014, filed on 10 May 2005. Priority is claimed on German Application No. 10 2004 023 926.6, filed on 12 May 2004.

BACKGROUND OF THE INVENTION

1. Field of the Invention

The invention relates to a sliding door system including a drive device disposed in a transom for at least one door leaf; an electromechanical actuation device for locking the at least one door leaf relative to the transom; and an endless traction means guided by a driven pulley of the drive device and tension-resistantly connected to the at least one door leaf.

2. Description of the Related Art

Generally, sliding door systems of the species mentioned above are automatic doors substantially consisting of glass, at which the opening operation being effected by an electrical impulse picked up by a drive device, the closing operation being automatically carried out with a time delay. Moreover, the ability to lock permanently one or more door leaves is required, with the door being open and being closed as well. In addition to manually actuated locking systems, automatically engaging locking systems are used. The invention is based on this type of locking system.

In particular, when locking a closed door, it is imperative to guarantee that no opening gap remains between adjoining door leaves.

In DE 44 15 708 C1 a locking system is described for the drive of a sliding door, wherein a tappet cooperates non-positively and positively with a continuous toothed belt. The tappet has a tappet part, which cooperates with a hook-shaped locking system. On the one hand, the locking hook is actuated via the tappet part, which travels over a releasing curvature, and on the other hand via the strand of the drive belt.

SUMMARY OF THE INVENTION

An object of the invention is to improve the response characteristics of the locking system for a sliding door system of the species mentioned above, i.e. it is intended that the locking can be effectively performed, even after the sliding door has been displaced over a very short distance only, and that the locking system does not consist of a rod locking system.

The invention solves the given problem with a sliding door system comprising: a transom; at least one door leaf movable along the transom; an endless traction mechanism traction-resistantly connected to the at least one door leaf; a drive device for driving the endless traction mechanism, the drive device comprising a driven pulley guiding the endless traction mechanism; a rotational body torsion-resistantly connected to the driven pulley and rotatably supported by the transom, the rotational body comprises a coupling member; a locking bolt displaceably supported by the transom; and an electromechanical actuation device, wherein the electromechanical actuation device is operable to cause the locking bolt to interlock with the coupling member of the rotational body to lock the at least one door leaf relative to the transom.

A driven pulley, preferably formed as a toothed disc, of the drive device effecting the sliding movement of the door leaf, according to the invention, is torque-proofly connected to a rotational body, so that the rotational body is fixed with respect to rotation relative to the pulley. The rotational body basically may be optionally embodied, and if necessary, may be an integral part of the driven pulley. It is essential that the rotational body has engaging or locking components, the disposition thereof at the rotational body being such that, in accordance with an impulse emitted by the locking control, they can engage with or disengage from a displaceable locking bolt, which is supported for example in the transom, even after the door was displaced over a very short sliding distance only. With an appropriate presetting of the rotational body or of engaging or locking components disposed at the rotational body, in harmonization with the locking control, it may be guaranteed for example that the locking system responds exactly when the door leaf is completely closed.

In an advantageous embodiment of the invention, the rotational body may be formed as a locking disc, i.e. the driven pulley is torque-proofly connected to a locking disc which rotates together with the driven pulley, complementary locking components being disposed at the locking disc and at a locking bolt, which, in accordance with an impulse of a locking control, is charged by the electromechanical actuation device and is displaceably supported in the transom.

According to the invention, the locking disc is a rotational body, torque-proofly but releasably linked to the driven pulley. The form of said body is adaptable, in particular with regard to the engaging and locking components, to the respective requirements. Moreover, in the event of wear, the rotational body is exchangeable.

According to another feature of the invention, the locking disc is torque-proofly connected to a shaft passing torque-proofly through the driven pulley, the shaft being rotatably supported in a bearing disposed in the transom, thus allowing for a simple coaxial arrangement of the driven pulley and the locking disc.

According to the invention, the locking disc is physically embodied in a pot-shape or bell-shape, a simple connection of the locking disc and the shaft being achieved, if a bell-bottom of a bell is clamped to the shaft.

In this case, the part of the bell, which forms the bell envelope, may have one or more locking components extending over the envelope circumference, which components may consist for example of apertures in the bell envelope, into which, in a locking position, a free end of the locking bolt engages, which is displaceably supported in the transom. Basically, the form of the locking components in the area of the envelope circumference of the bell envelope, or of the complementary locking components at the locking bolt may be formed optionally; for example a toothing could be provided at the exterior wall of the bell envelope, in which toothing a corresponding mating toothing of the locking bolt engages.

According to an exemplary embodiment of the invention, the electromechanical actuation device is formed as a bistable electromagnet, i.e. the electromagnet is maintained in its respective final position by means of two windings and in accordance with the impulse respectively. In this case, it has proven to be useful to dispose an intermediate lever between the push-rod of the actuation device and the locking bolt, which lever is pivotably linked to both the push-rod and the locking bolt, and is rotatable about a rotation axis, which is stationary linked to the transom. The intermediate lever, pivoted by means of the push-rod of the actuation device, thus effects the locking or unlocking.

Provided that, in another embodiment of the invention, the actuation device consists of a stable, i.e. non self-holding electromagnet, the invention proposes that the intermediate lever has a permanent magnet at one free end, such as to dispose, in the area of the permanent magnet at the intermediate lever, a permanent magnet stationary fixed at the transom, with the pole faces of the permanent magnets facing each other having a like polarity, such that, in the respective final position of the push-rod of the electromechanical actuation device, the permanent magnets repelling each other have the maximal distance. When using a stable electromagnet in such a device, it can be guaranteed that the locking bolt reliably remains in the locked or in the unlocked position. Naturally, it is likewise possible to use an electric motor as the actuation device instead of a magnet.

BRIEF DESCRIPTION OF THE DRAWINGS

In the following, the invention will be explained in more detail based on two diagrammatically illustrated exemplary embodiments, in which.

DETAILED DESCRIPTION OF THE PRESENTLY PREFERRED EMBODIMENTS

Figure 1:
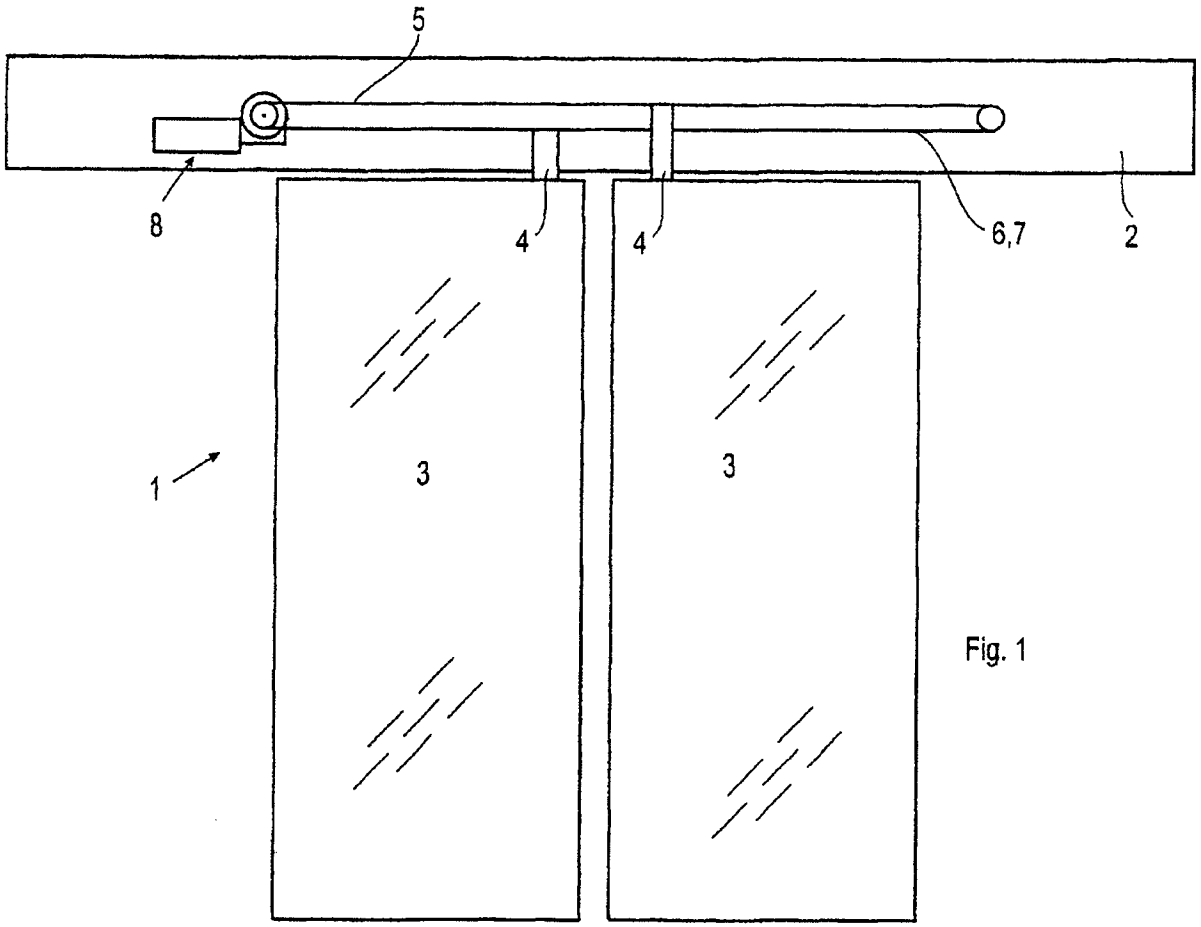
FIG. 1 shows a diagrammatic view of the sliding door system.

As shown in the exemplary embodiment of FIG. 1, a sliding door system 1 consists of two door leaves 3, which are displaceably guided in or at a transom 2 by means of a roller rail (not illustrated). A drive device generally identified by 8 drives an endless traction means 7, one door leaf 3 being connected to the upper strand 5 and a second door leaf 3 to the lower strand 6 of the endless traction means or mechanism 7 by means of one respective connecting member 4.

Figure 2:
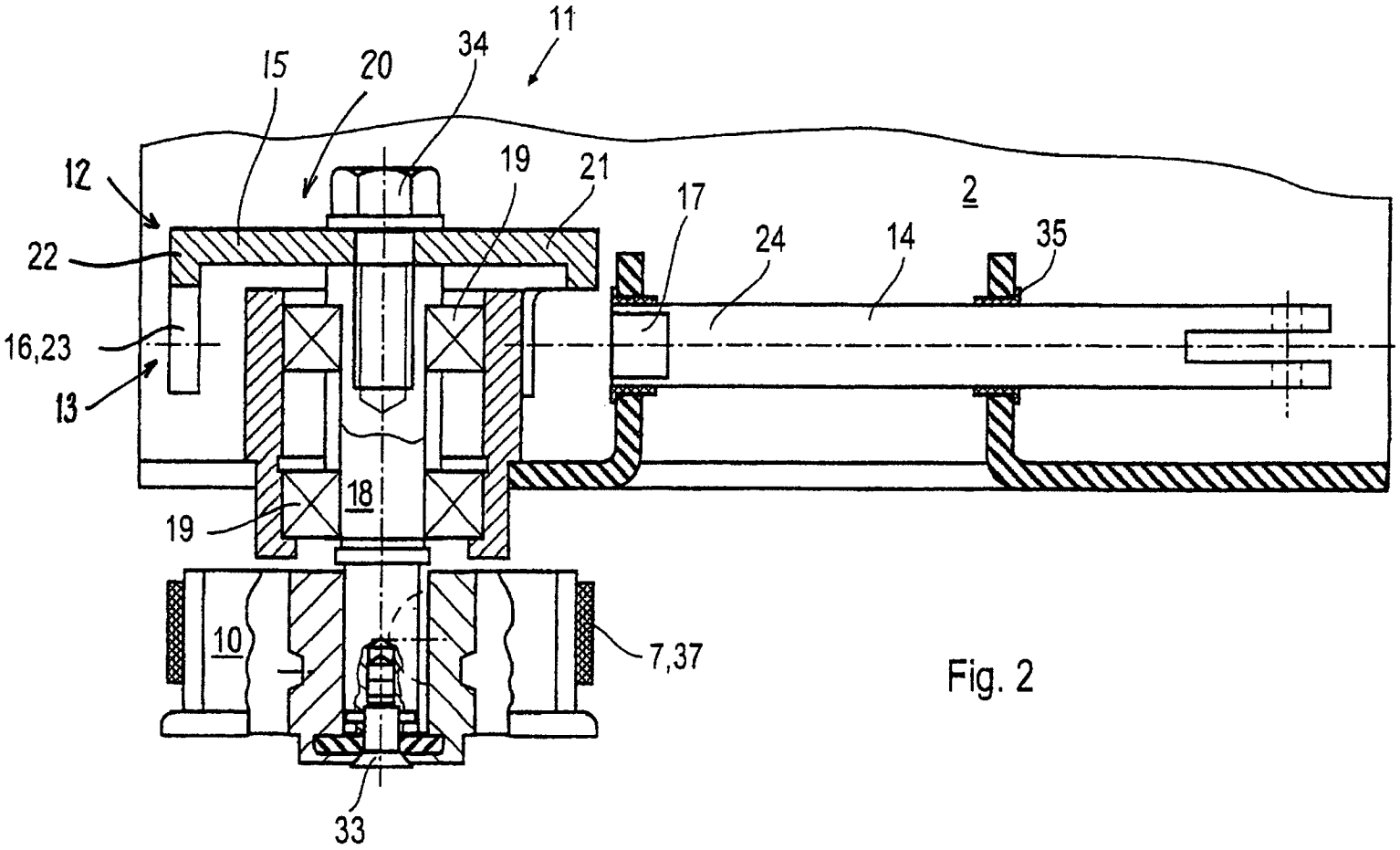
FIG. 2 shows an enlarged illustration, in relation to FIG. 1, of a partial horizontal section through a transom with a driven pulley of the drive and the locking system being disengaged.

As revealed in FIG. 2, the endless traction means 7, formed as a toothed belt 37, is guided around a driven pulley 10 of the drive system 8, not shown in FIG. 2. A shaft 18, while being torque-proofly supported in the driven pulley 10 by means of a screw connection 33 and, at the other end, being supported by means of a bearing 19 in the transom 2, passes through the driven pulley 10. The front-end portion of the shaft 18, supported in the transom 2, is contained in a rotational body 12, which, together with a locking bolt 14, which is displaceably supported in bearings 35 of the transom 2, forms a coupling member 13. The coupling member 13 virtually constitutes a locking disc 15, which, in the exemplary embodiment, is represented as a bell 20. As can be seen, a bell-bottom 21 is clamped to the shaft 18 by means of a screw connection 34.

Figure 3:
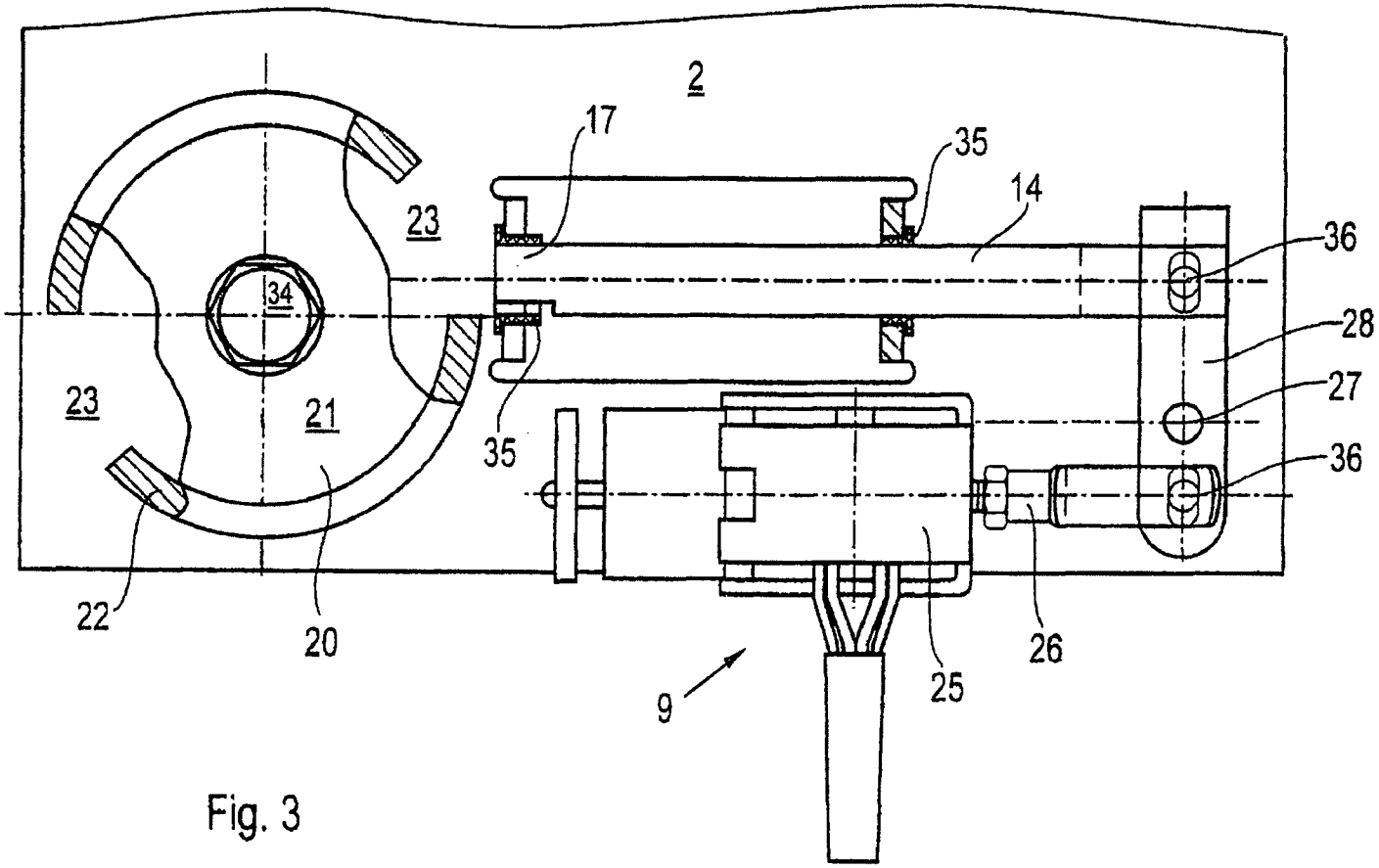
FIG. 3 shows a vertical partial section through the transom according to FIG. 2, the locking system being disengaged.
Figure 4:
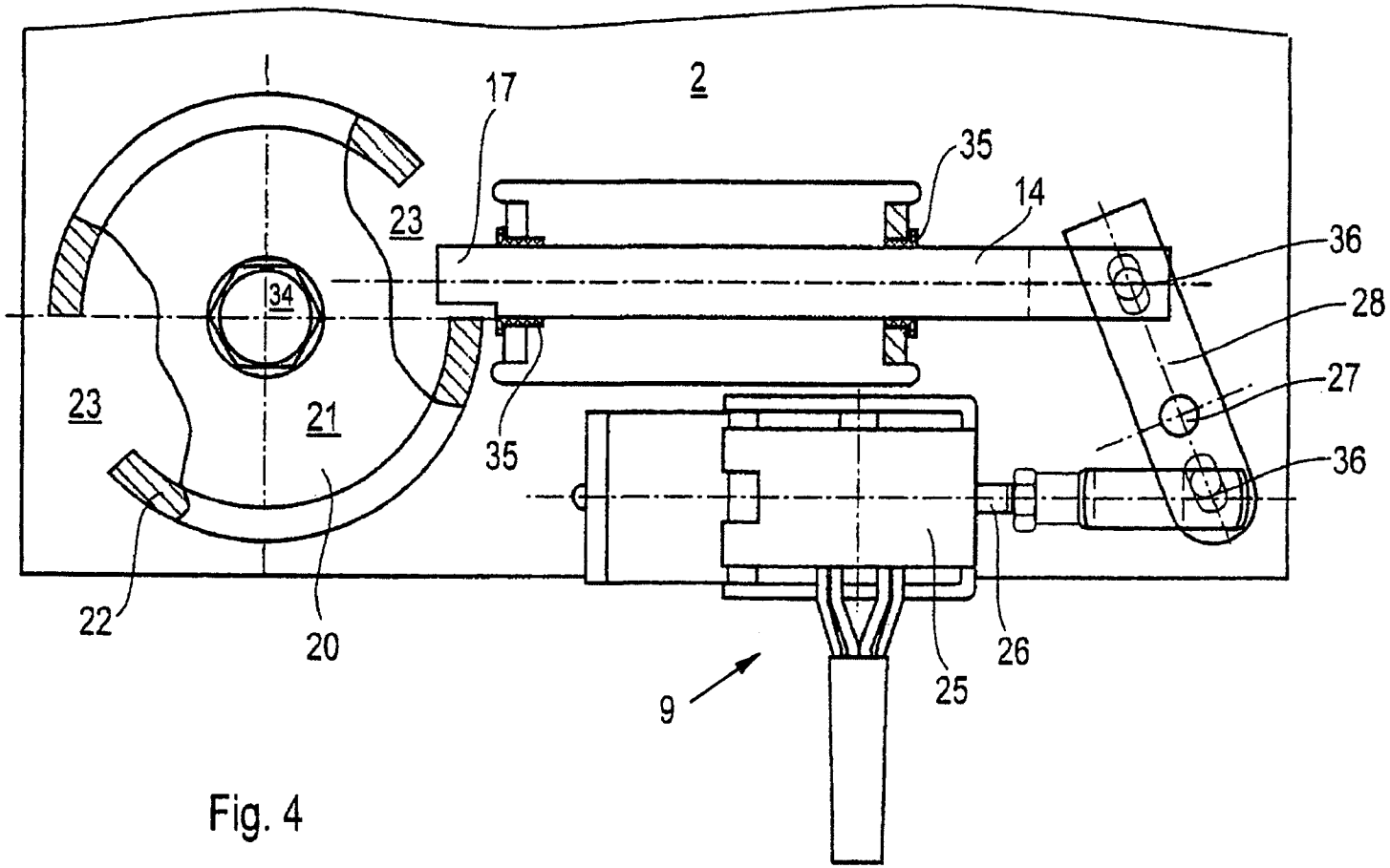
FIG. 4 shows the vertical partial section through the transom according to FIG. 3, the locking system being engaged.
Figure 5:
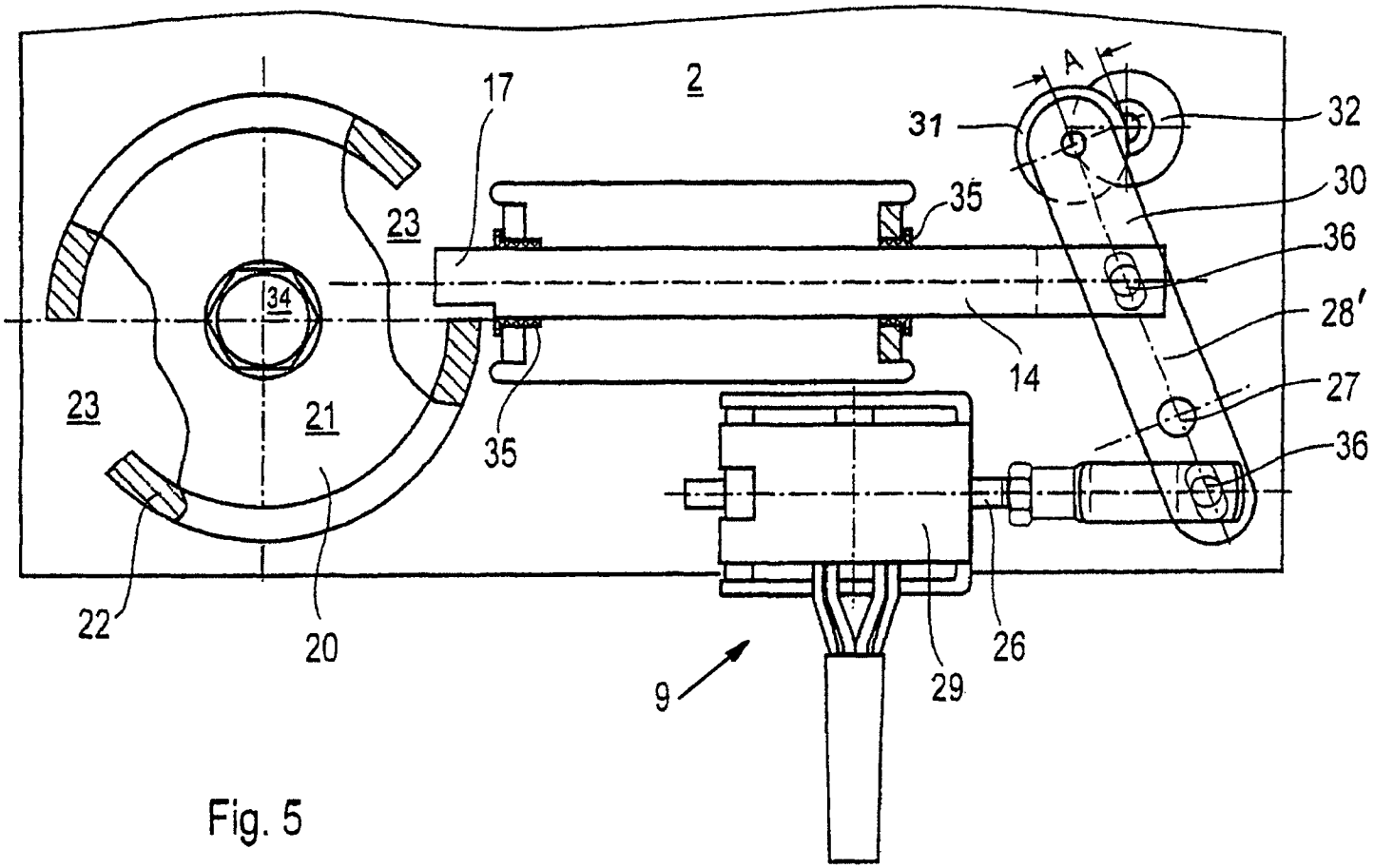
FIG. 5 shows the vertical partial section through the transom according to FIG. 4, where a stable electromagnet is used.

As also depicted in FIGS. 3 to 5, apertures 23 are provided in the bell envelope 22. These apertures 23 form the locking components 16, which are complementary to the locking component 17 at the free end of the locking bolt 14 and thus constitute the locking system generally identified by 11.

In the exemplary embodiment according to FIGS. 3 and 4, the electromagnetic actuation device consists of a bistable electromagnet, i.e. by using two separately controllable windings, in accordance with the locking impulse, the locking bolt 14 is able to engage in the aperture 23 or to disengage from the aperture 23. The number of apertures 23 across the circumference of the bell envelope 22 can be adapted to the respective circumstances. As FIGS. 3 to 5 further reveal, an intermediate lever 28 is linked, on its one side, to the push-rod 26 of the actuation device 9 and, on the other side, to the locking bolt 14, which lever is respectively supported in swivel joints 36 at the push-rod 26 and at the locking bolt 14. The intermediate lever 28 pivots about a rotating shaft 27, which is stationary disposed at the transom 2.

A second exemplary embodiment according to FIG. 5 is based on using a stable electromagnet 29, i.e., non self-holding electromagnet; for reliably securing the locking bolt 14 in the locking position or in the unlocking position, a permanent magnet 31 is disposed in the area of the free end 30 of the intermediate lever 28', which magnet cooperates with a permanent magnet 32 stationary disposed at the transom 2. In this case, the polarity is chosen such that both electromagnets repel each other and, in the illustrated locking position, they have a maximal distance A. When switching the actuation device 9, the electromagnet 31 pivots to the right side (not illustrated) in the plane of the illustration, beyond the position of the permanent magnet 32, and thus holds the locking bolt 14 in the unlocked position.

What is claimed is:

1. A drive system for a sliding door system comprising at least one door leaf guided along a transom, the drive system comprising:

a pulley which can be rotated by a drive device;

a shaft passing through the pulley and fixed relative to the pulley;

an endless traction mechanism guided around the pulley for moving the at least one door leaf linked to the traction mechanism;

a rotational body which is separate from the pulley and configured to be mounted for rotation in the transom, said rotational body being fixed to the shaft so that the rotational body rotates with the shaft and the pulley, the rotational body is bell-shaped and formed by a bottom wall and a circumferential envelope wall, the circumferential envelope wall having at least one aperture;

a locking bolt which is configured to be displaceably supported in the transom and movable to engage the at least one aperture of the rotational body thereby preventing rotation of the pulley; and an electromechanical actuation device which moves the locking bolt in response to an impulse emitted by a locking control.

2. The drive system of claim 1, wherein the rotational body and the locking bolt form a coupling member and the locking bolt has a complementary locking component on a free end of the locking bolt configured to engage in the at least one aperture.

3. The drive system of claim 1, further comprising a bearing configured to be supported by the transom, the shaft being rotatably supported by the bearing.

4. The drive system of claim 1, wherein the rotational body and the locking bolt form a coupling member, the circumferential envelope wall of the rotational body constituting a locking component, the locking bolt having a complementary locking component on a free end of the locking bolt.

5. The drive system of claim 4, wherein the locking bolt is in a locking position when the free end of the locking bolt is in the at least one aperture of the circumferential envelope wall.

6. The drive system of claim 1, further comprising an intermediate lever, and a shaft disposed between a push-rod of the actuation device and the locking bolt and stationarily connected to the transom, the intermediate lever being pivotably connected to the push-rod, the shaft, and the locking bolt.

7. The drive system of claim 1, wherein the actuation device comprises an electromagnet.

8. The drive system of claim 7, further comprising an intermediate lever, and a rotating shaft disposed between a push-rod of the actuation device and the locking bolt and stationarily connected to the transom, the intermediate lever being pivotably connected to the push-rod, the rotating shaft, and the locking bolt, the intermediate lever having a free end which is closer to the push-rod than to the rotating shaft, and a first permanent magnet attached to the free end, the sliding door system further comprising a second permanent magnet disposed adjacent to the first permanent magnet and stationarily supported by the transom, polarities of the first and second permanent magnets are such that the first and second permanent magnets repel each other and have a maximum distance to each other when the push-rod is in a respective final position to maintain the locking bolt in a locked or an unlocked position.

9. The drive system of claim 1, wherein the locking bolt is movable in a direction transverse to the shaft.

10. The drive system of claim 1, wherein the actuation device comprises a bistable electromagnet.

11. The drive system of claim 10, further comprising an intermediate lever, and a rotating shaft disposed between a push-rod of the actuation device and the locking bolt and stationarily connected to the transom, the intermediate lever being pivotably connected to the push-rod, the rotating shaft, and the locking bolt, the intermediate lever having a free end which is closer to the push-rod than to the rotating shaft, and a first permanent magnet attached to the free end, the sliding door system further comprising a second permanent magnet disposed adjacent to the first permanent magnet and stationarily supported by the transom, polarities of the first and second permanent magnets are such that the first and second permanent magnets repel each other and have a maximum distance to each other when the push-rod is in a respective final position to maintain the locking bolt in a locked or an unlocked position.

* * * * *